US010581130B2

(12) United States Patent
Ferrando et al.

(10) Patent No.: US 10,581,130 B2
(45) Date of Patent: Mar. 3, 2020

(54) ROTARY JOINT FOR A ROTARY ANTENNA AND ROTARY ANTENNA COMPRISING SUCH A JOINT

(71) Applicant: THALES, Courbevoie (FR)

(72) Inventors: Nicolas Ferrando, Toulouse (FR); Jérôme Brossier, Toulouse (FR); Pierre Bosshard, Toulouse (FR); Yann Cailloce, Toulouse (FR); Jérôme Lorenzo, Toulouse (FR)

(73) Assignee: Thales, Courbevoie (FR)

( * ) Notice: Subject to any disclaimer, the term of this patent is extended or adjusted under 35 U.S.C. 154(b) by 15 days.

(21) Appl. No.: 16/133,719

(22) Filed: Sep. 18, 2018

(65) Prior Publication Data

US 2019/0089029 A1 Mar. 21, 2019

(30) Foreign Application Priority Data

Sep. 19, 2017 (FR) ..... 17 00950

(51) Int. Cl.
*H01Q 13/12* (2006.01)
*H01P 1/06* (2006.01)
(Continued)

(52) U.S. Cl.
CPC ..... *H01P 1/069* (2013.01); *H01P 1/065* (2013.01); *H01P 1/068* (2013.01); *H01Q 1/288* (2013.01);
(Continued)

(58) Field of Classification Search
CPC ..... H01Q 1/1207–1/1264; H01Q 3/02–3/20; H01Q 13/0258; H01Q 19/18–19/19; H01P 1/06
See application file for complete search history.

(56) References Cited

U.S. PATENT DOCUMENTS 4,533,887 A 8/1985 Moerz et al.
8,180,187 B2 * 5/2012 Bunch ..... H01Q 1/1257 385/25
(Continued)

FOREIGN PATENT DOCUMENTS

FR 2984612 A1 6/2013
FR 3029018 A1 5/2016

OTHER PUBLICATIONS

French Patent Application No. 17 00950, INPI Rapport de Recherche Préliminaire, mailed on Jul. 4, 2018, 2 pages.

*Primary Examiner* — Dameon E Levi
*Assistant Examiner* — Hasan Z Islam
(74) *Attorney, Agent, or Firm* — Soquel Group LLC

(57) ABSTRACT

A rotary joint including a stator intended to be fastened on a first part of the antenna and defining a transmission surface, and a rotor intended to be fastened on a second part of the antenna and defining a transmission surface, wherein one of the transmission surfaces includes primary means for delimiting electromagnetic signals and the other includes complementary means for delimiting electromagnetic signals; the rotor being mounted rotating relative to the stator such that at least part of the transmission surface of the rotor is positioned across from at least part of the transmission surface of the stator, the facing parts forming at least one transmission path between them for the electromagnetic signals delimited by the primary and complementary delimiting means.

12 Claims, 5 Drawing Sheets

(51) Int. Cl.

| | |
|---|---|
| ***H01Q 1/28*** | (2006.01) |
| ***H01Q 3/20*** | (2006.01) |
| ***H01Q 3/08*** | (2006.01) |
| ***H01Q 13/02*** | (2006.01) |
| ***H01Q 19/19*** | (2006.01) |
| ***H01Q 19/13*** | (2006.01) |
| *H01P 3/123* | (2006.01) |

(52) U.S. Cl.

CPC ..... *H01Q 3/08* (2013.01); *H01Q 3/20* (2013.01); *H01Q 13/0258* (2013.01); *H01Q 19/136* (2013.01); *H01Q 19/193* (2013.01); *H01P 3/123* (2013.01)

(56) References Cited

U.S. PATENT DOCUMENTS

| | | | | |
|---|---|---|---|---|
| 9,647,334 | B2 * | 5/2017 | Lanciault ..... | H01Q 3/20 |
| 2010/0149058 | A1 | 6/2010 | Bosshard et al. | |
| 2011/0187614 | A1 | 8/2011 | Kirino et al. | |
| 2014/0104125 | A1 * | 4/2014 | Choiniere ..... | H01Q 3/08 343/761 |
| 2016/0126629 | A1 * | 5/2016 | Cherrette ..... | H01Q 3/34 342/372 |
| 2016/0149280 | A1 | 5/2016 | Thales | |

* cited by examiner

ROTARY JOINT FOR A ROTARY ANTENNA AND ROTARY ANTENNA COMPRISING SUCH A JOINT

CROSS-REFERENCE TO RELATED APPLICATIONS

This application claims priority of French Patent Application No. 17 00950, filed on Sep. 19, 2017.

FIELD OF THE INVENTION

The present invention relates to a rotary joint and a rotary antenna comprising such a joint.

Such an antenna has a high degree of azimuth and elevation aiming agility, and is in particular usable in the space field. More particularly, it may be mounted on satellites having a smaller outer surface while providing the reception and transmission of electromagnetic signals for a wide bandwidth.

BACKGROUND OF THE INVENTION

Similar antennas are already known in the state of the art.

Thus for example, document FR 3,029,018 describes a biaxial antenna comprising a stationary part installed on a base and a rotating part mounted on said stationary part. The antenna further comprises a first actuator allowing the rotating part to rotate around a first rotation axis perpendicular to the base to modify the azimuth angle of the antenna.

The stationary and rotating parts of said antenna are connected by a connecting device arranged between them along the first rotation axis and making it possible to transmit electromagnetic signals between said parts.

In particular, said connecting device is made up of a rotary joint and two exciters arranged on either side of the rotary joint and making it possible to develop radiofrequency waves either in the circularly polarized fundamental electromagnetic mode or in the electromagnetic mode with symmetry of revolution.

The rotary joint forms a waveguide with a circular section in particular allowing the propagation of two cross-polarized electromagnetic signals between the two exciters.

The rotating part of said antenna in particular comprises a reflection assembly made up of a reflector and mirror that are positioned to face one another to orient the electromagnetic signals emitted by a radiating source in a visibility domain of the antenna or to receive electromagnetic signals from said domain. The radiating source is connected to the connecting module in particular via an exciter.

Furthermore, the rotating part defines a second rotation axis and includes a second actuator able for example to rotate the mirror around said second rotation axis to modify the incline angle of said mirror relative to the reflector.

Thus, the aiming of such an antenna along a given azimuth angle and elevation angle is done by actuating the first and second actuators appropriately.

However, said antenna and in particular the rotary joint belonging to said antenna are not completely satisfactory.

In particular, the rotary joint previously described does not allow the antenna to receive and send electromagnetic signals with a bandwidth greater than 1 GHz without significant deterioration of the performance of the antenna.

SUMMARY OF THE DESCRIPTION

To that end, the invention relates to a rotary joint for a rotary antenna, comprising a first part and a second part rotating relative to the first part, the rotary joint being intended to connect the first part and the second part of the antenna and to transmit electromagnetic signals between said parts, having a ring sector shape with a variable opening and defining a rotation axis passing through the ring center, a plurality of radial directions extending from the ring center toward its periphery and a plurality of circumferential directions extending along concentric circles arranged around the rotation axis.

The rotary joint includes a stator intended to be fastened on the first part of the antenna and defining a surface for transmitting electromagnetic signals, perpendicular to the rotation axis; and a rotor intended to be fastened on the second part of the antenna and defining a surface for transmitting electromagnetic signals, perpendicular to the rotation axis.

One of the transmission surfaces includes primary means for delimiting electromagnetic signals and the other includes complementary means for delimiting electromagnetic signals.

The rotor is mounted rotating relative to the stator around the rotation axis such that in any position of the rotor, at least a part of the transmission surface of the rotor is positioned to face at least a part of the transmission surface of the stator.

In any position of the rotor, the facing parts of the transmission surfaces of the rotor and the stator form at least one transmission path between them for the electromagnetic signals, the transmission path being delimited by the primary and complementary delimiting means and extending in a circumferential direction.

According to other advantageous aspects of the invention, the joint includes one or more of the following features, considered alone or according to all technically possible combinations:

- in any position of the rotor, the facing parts of the transmission surfaces of the rotor and the stator form at least two transmission paths between them for the electromagnetic signals, called circumferential paths, the circumferential paths being delimited by the primary and complementary delimiting means and extending in a same circumferential direction;
- in any position of the rotor, the facing parts of the transmission surfaces of the rotor and the stator form at least two transmission paths between them for the electromagnetic signals, called radial paths, the radial paths being delimited by the primary and complementary delimiting means and extending in different circumferential directions;
- the radial path extending along the circumferential direction closer to the rotation axis than the circumferential direction of the other radial path or each other radial path, is intended to transmit the electromagnetic signals received by the antenna; and
- the radial path extending along the circumferential direction further from the rotation axis than the circumferential direction of the other radial path and each other radial path, is intended to transmit the electromagnetic signals to be sent by the antenna;
- the primary delimiting means protrude relative to the corresponding transmission surface to form at least one transmission channel extending along a circumferential direction and delimited by said delimiting means along each radial and circumferential direction passing through said channel;
- the complementary delimiting means protrude relative to the corresponding transmission surface and are received in the or each transmission channel movably in order to delimit the circumferential expanse of said channel as a function of the position of the rotor;

the or each transmission path being formed by a portion delimited by the complementary delimiting means of the transmission channel or one of the transmission channels;

the circumferential paths are formed by adjacent portions of a same transmission channel divided by the complementary delimiting means;

for the or each transmission channel, the transmission surface of the stator defines at least one opening positioned on one of the ends of said channel;

for the or each opening of the transmission surface of the stator, the transmission surface of the rotor defines an opening positioned over the same circumferential direction as said opening of the transmission surface of the stator;

the or each transmission path extending between the opening or one of the openings of the transmission surface of the stator and the opening of the transmission surface of the rotor corresponding to it;

the primary and complementary delimiting means assume the form of a plurality of studs spaced apart from one another;

the studs of the primary delimiting means are distributed on the corresponding transmission surface in several circumferential directions and several radial directions; and the transmission surfaces of the rotor and the stator are separated from one another along the rotation axis without forming points of contact.

The invention also relates to a rotary antenna comprising a first part, a second part rotating relative to the first part, and a rotary joint as defined previously, intended to connect the first and second parts of the antenna and to transmit electromagnetic signals between said parts.

BRIEF DESCRIPTION OF THE DRAWINGS

These features and advantages of the invention will appear upon reading the following description, provided solely as a non-limiting example, and done in reference to the appended drawings, in which.

DETAILED DESCRIPTION

In the rest of the description, the expression "substantially equal to" refers to an equivalency relationship with a relative error of less than 10%.

Figure 1:
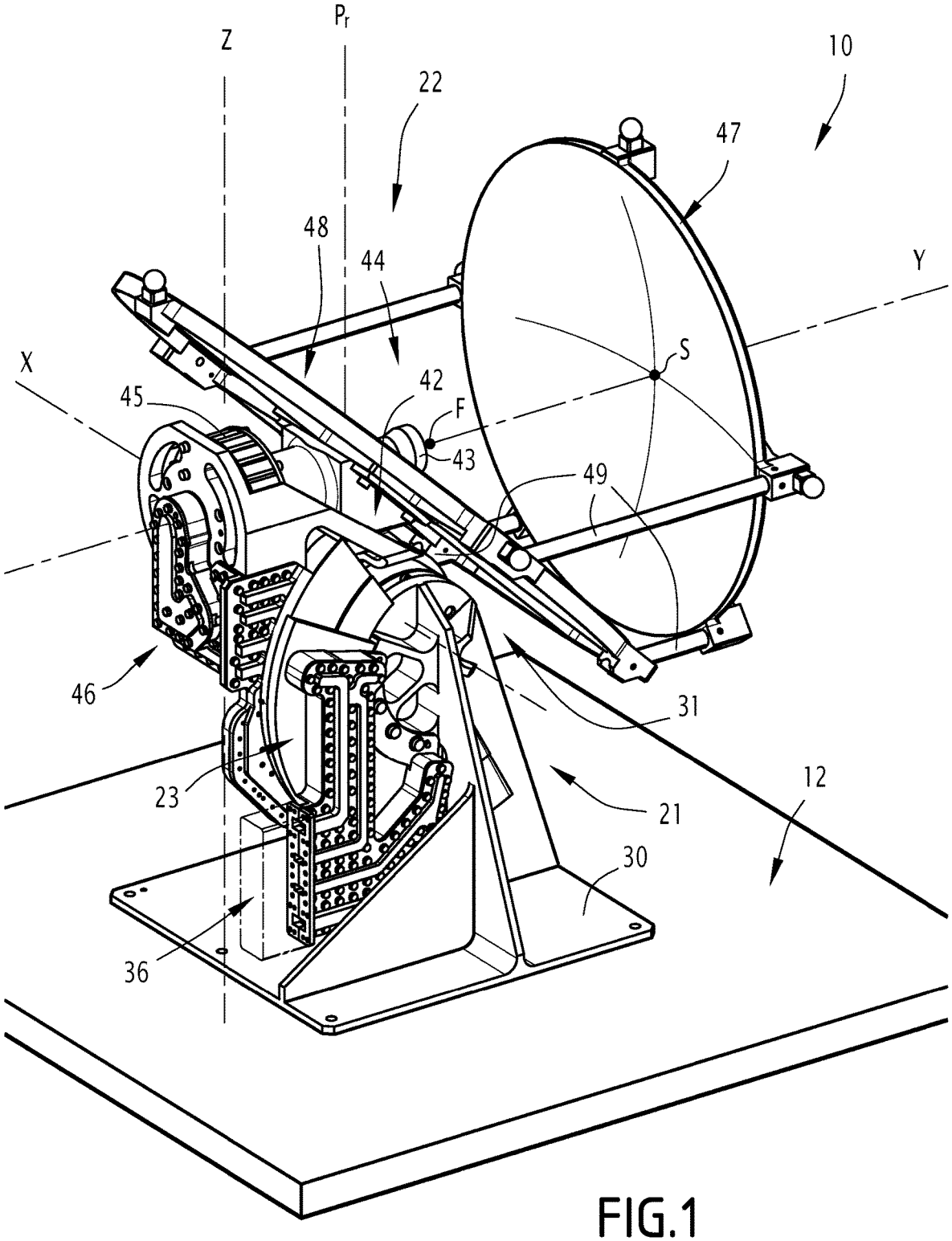
FIG. 1 is a schematic perspective view of a rotary antenna according to the invention, the antenna forming a radiofrequency chain.

The antenna 10 of FIG. 1 is a biaxial antenna that is in particular usable in the space field to receive and send electromagnetic signals in the Ka band with bipolarization. These electromagnetic signals therefore have radio waves.

The antenna 10 forms a radiofrequency channel 11 made up of four transmission paths for electromagnetic signals, among which two paths are reception paths, i.e., paths of the Rx type, and the other two paths are transmission paths, i.e., paths of the Tx type.

The antenna 10 is for example mounted on an outer surface of the satellite (not shown) placed into low Earth orbit, for example. Such an outer surface includes a base comprising mechanical fastening means and electromechanical connecting means for the antenna 10 with respect to the satellite.

The mechanical fastening means make it possible to fasten the antenna 10 mechanically to the base.

The electromagnetic connecting means make it possible to provide the transmission of all of the electromagnetic signals between the antenna 10 and the satellite, such as signals received by the antenna 10, signals intended to be sent by the antenna 10 and electric supply signals of the antenna 10.

In general, the mechanical connecting means and the electromagnetic connecting means are known as such and will not be described in detail hereinafter.

The base positioned on the outer surface of the satellite further has, at least locally, a base plane 12 visible in FIG. 1.

According to other embodiments, the base has any other shape suitable for fastening the antenna 10 in a manner known in itself. In this case, a base plane refers to a plane formed by any three points of contact of the antenna 10 with the base.

In reference to FIG. 1, the antenna 10 includes a first part 21 intended to be fastened on the base, a second part 22 mounted rotating around a first axis X also called rotation axis, on the first part 21, and a rotary joint 23 according to the invention, positioned between the first and second parts 21, 22.

The first part 21 includes an antenna support 30, a rotary support 31, a first actuator (not visible in FIG. 1) and first guide means 36 (shown schematically by a rhomb in FIG. 1) connecting the antenna 10 to the electromagnetic connecting means of the antenna 10.

The antenna support 30 has a mechanical structure necessary to support the set of components of the antenna 10. Furthermore, the antenna support 30 allows the antenna 10 to be fastened to the base, and in particular the base plane 12 via the aforementioned mechanical fastening means.

The rotary support 31 has a mechanical connection of the second part 22 of the antenna 10 to the first part 21. Thus for example, the rotary support has a shaft rotating relative to the first part 21 and secured to the second part 22. Said shaft is arranged along the first axis X.

The first actuator is able to rotate the rotary support 31 around the first axis X in order to rotate the second part 22 of the antenna 10 relative to said axis X.

In particular, the first actuator for example has an electric motor integrated into the antenna support 30 and when the rotary support 31 assumes the form of a rotary shaft, able to drive a rotating movement of said shaft. Such a motor is connected to the first guide means 36 in order to receive electric supply signals from the satellite. Said signals in particular make it possible to activate the operation of the motor in order to rotate the rotary support 31 and reach a desired elevation angle Θ.

The elevation angle Θ of the antenna 10 in particular corresponds to the angle formed between a second axis Y and the base plane 12. The second axis Y is perpendicular to the first axis X and to a third axis Z perpendicular to the base plane 12.

The first actuator is for example configured to vary the elevation angle Θ of the antenna between −30° and 30°, or preferably between −60° and 60°.

The second part 22 of the antenna 10 includes a second rotary support 42, a radiating source 43, a reflection assembly 44, a rotary assembly 45, a second actuator (not visible in FIG. 1) and second guide means 46 for the electromagnetic signals.

The second rotary support 42 has a mechanical structure capable of supporting the set of components of the second part 22 of the antenna 10. It further makes it possible to fasten the second part 22 of the antenna 10 to the first part 21 so as to rotate around the first axis X.

Thus for example, when the first rotary support 31 assumes the form of a rotary shaft, the second rotary support 42 is secured to said shaft.

The radiating source 43 is able to send and receive electromagnetic signals and for example assumes the form of a horn for sending and receiving radio waves, known in itself.

According to another example embodiment, the radiating source 43 assumes the form of a plurality of horns for sending and/or receiving radio waves.

The radiating source 43 is mounted so as to be stationary on the second rotary support 42 and is oriented along the second axis Y.

When the radiating source 43 assumes the form of a single horn, said horn is therefore oriented along the second axis Y. When the radiating source 43 assumes the form of a plurality of horns, maximizing the efficiency of the antenna requires that the horns be oriented toward the center of a reflector 47 of the reflecting assembly 44. However, for reasons related to the cost of the solution, the horns may be oriented along the second axis Y.

Aside from the reflector 47, the reflecting assembly 44 comprises a mirror 48 positioned around the radiating source 43 and the fastening means 49.

The reflector 47, known in itself, is positioned to face the radiating source 43 and for example has a symmetrical parabolic shape defining a reflector apex S and a focus F that are visible in FIG. 1. The reflector apex S for example has the point of symmetry of the reflector 47. Furthermore, the reflector apex S and the focus F are positioned on the second axis Y.

The mirror 48 is for example a flat ring-shaped mirror, at the center of which the radiating source 43 is positioned. In this case, the mirror 48 defines a mirror plane and is positioned such that the first axis X is parallel to the mirror plane or comprised therein.

The fastening means 49 make it possible on the one hand to fasten the mirror 48 to the rotary assembly 45 and on the other hand, the reflector 47 to the mirror 48.

In particular, between the reflector 47 and the mirror 48, the fastening means 49 assume the form of a plurality of brackets positioned at different levels relative to the second axis Y. Thus, in the example of FIG. 1, two brackets are positioned parallel to one another in the part of the reflecting assembly 44 having the shortest distance between the reflector 47 and the mirror 48, and two brackets are positioned parallel to one another in the part of the reflecting assembly 44 having the half of the longest distance between the reflector 47 and the mirror 48. An axis perpendicular to the plane formed by these last two brackets and passing through the center of the mirror 48 will be referred to hereinafter as incline direction A of the reflecting assembly 44.

The reflecting assembly 44, and in particular the mirror 48 positioned so as to be stationary relative to the reflector 47, define a propagation axis Pr of the electromagnetic signals.

In particular, the propagation axis Pr corresponds to the direction along which the reflecting assembly 44 is able to transmit electromagnetic signals sent by the radiating source 43 and along which the reflecting assembly 44 is able to receive electromagnetic signals to transmit them to the radiating source 43.

In the described example, the propagation axis Pr is perpendicular to the second axis Y. Furthermore, in the position of the reflecting assembly 44 shown in FIG. 1, the propagation axis Pr is parallel to the third axis Z and the plane formed by the propagation axis Pr and the second axis Y is perpendicular to the first axis X.

The rotary assembly 45 is mounted rotating on the second rotary support 42, around the second axis and secured to the fastening means 49 and the reflecting assembly 44. Thus, the rotation of the rotary assembly 45 around the second axis Y drives the rotation of the reflecting assembly 44 around the radiating source 43.

The second actuator is for example integrated into the second rotary support 42 and is connected to the rotary assembly 45 to drive a rotational movement of said assembly.

The second actuator is for example substantially similar to the first actuator and in particular assumes the form of an electric motor. Said motor is then connected to a rotary shaft included in the rotary assembly 45.

Like the first actuator, the second actuator is supplied with electric supply signals coming from the satellite making it possible to activate its operation to reach a desired incline angle α of the reflecting assembly 44. The incline angle α of the reflecting assembly 44 corresponds to the angle formed between the incline axis A (in particular visible in FIG. 6) of the reflecting assembly 44 and the third axis Z.

The second actuator is for example configured to vary the incline angle α of the reflecting assembly 44 between −30° and 30°, or preferably between −60° and 60°.

The first and second guide means 36, 46 make it possible to guide electromagnetic signals within the antenna 10. Said means will be explained in more detail in reference to FIGS. 2 and 3, respectively illustrating a perspective view and an exploded perspective view of the radiofrequency chain 11. Radiofrequency chain refers to the set of components of the first and second parts 21, 22 of the antenna 10 participating in transmitting electromagnetic signals within the antenna 10.

Indeed, as illustrated in said figures, the radiofrequency chain 11 is made up of the radiating source 43, the second guide means 46, the rotary joint 23 and the first guide means 36.

The first guide means 36 make it possible to connect the electromagnetic connecting means of the satellite to the rotary joint 23 and the second guide means 46 make it possible to connect the rotary joint 23 to the radiating source 43.

In particular, the first guide means 36 have four transmission paths formed by guide waves and/or coaxial cables that are bent appropriately based on the positioning of the electromagnetic connecting means of the satellite and the rotary joint 23.

Each transmission path of the first guide means 36 is a radiofrequency access path to the rotary joint 23. In the example embodiment of FIG. 1, two paths make it possible to transmit electromagnetic signals for two orthogonal polarizations and the other two paths make it possible to receive electromagnetic signals for two orthogonal polarizations.

The second guide means 46 have four transmission paths formed by guide waves and/or coaxial cables that are bent appropriately based on the positioning of the rotary joint 23 and the radiating source 43.

Figure 2:
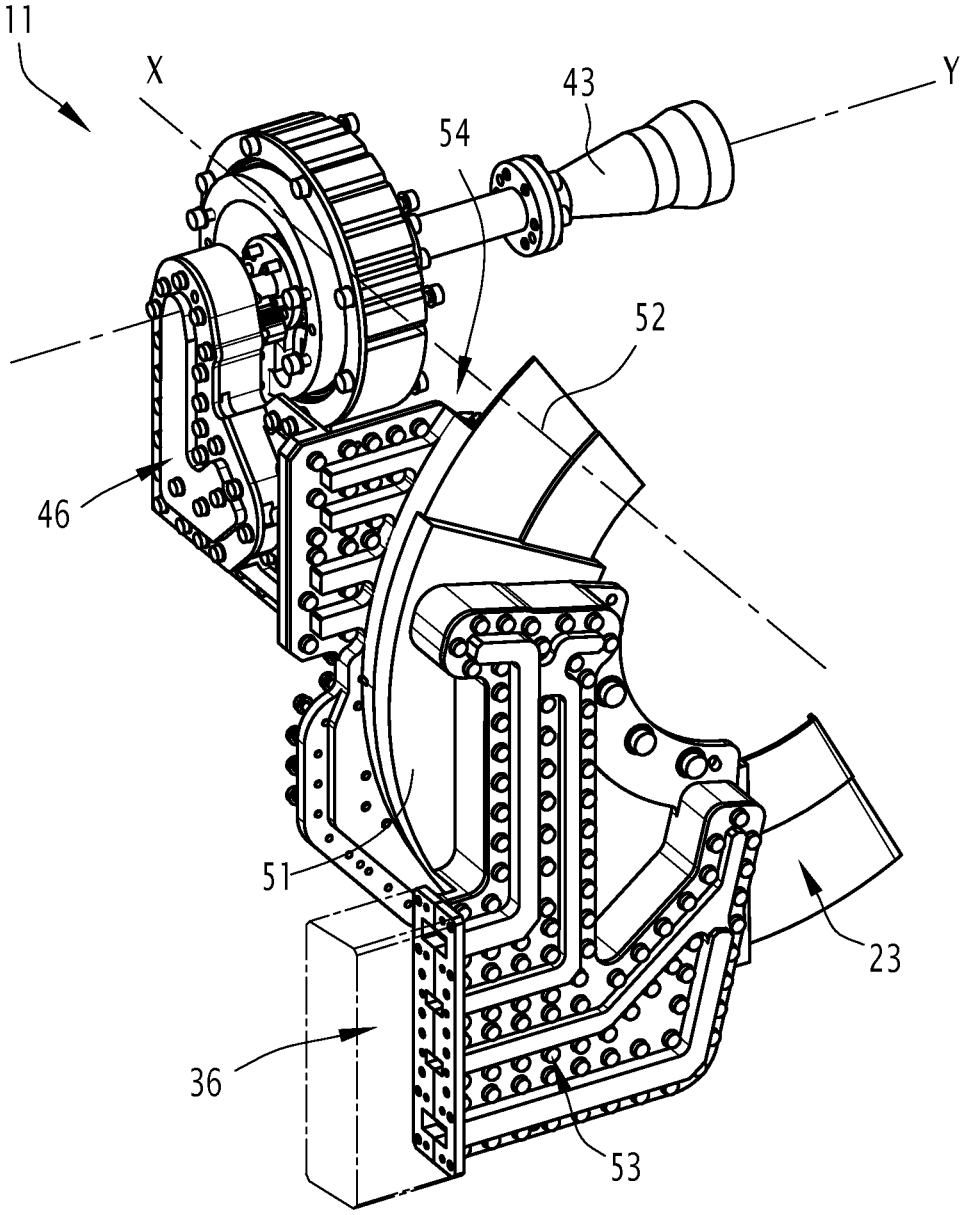
FIG. 2 is a schematic perspective view of the radiofrequency chain of FIG. 1, the radiofrequency chain comprising a rotary joint according to the invention comprising a stator and a rotor.
Figure 3:
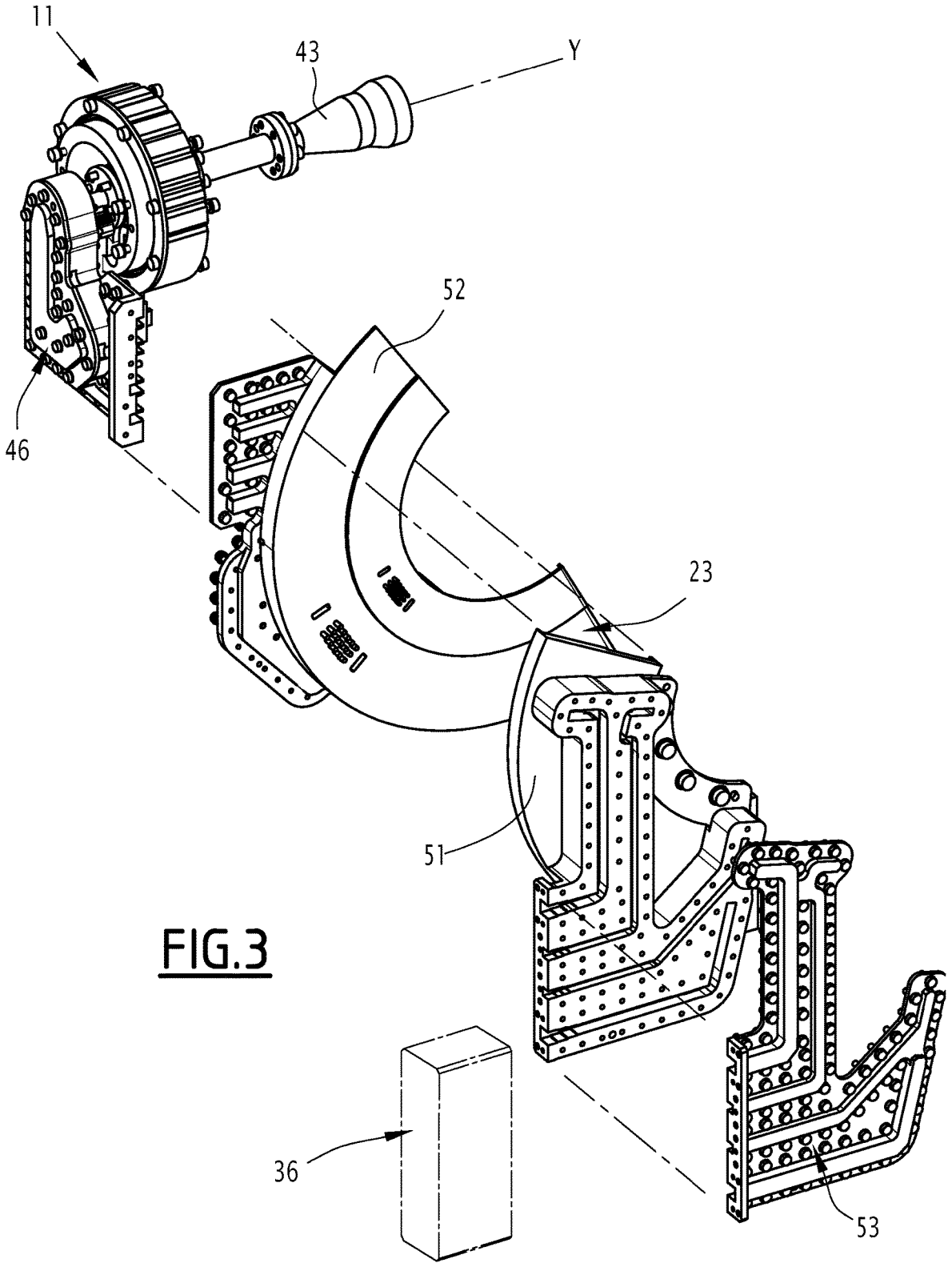
FIG. 3 is an exploded schematic perspective view of the radiofrequency chain of FIG. 1.

More particularly, in the example embodiment of FIGS. 2 and 3, said waveguides and/or said cables are bent such that the electromagnetic signals received by the radiating source 43 along the second axis Y are propagated toward the rotary joint 23 along axes parallel to the first axis X and the electromagnetic signals coming from the rotary joint 23 along axes parallel to the first axis X are propagated along the second axis Y in the radiating source 43.

Like in the previous case, two transmission paths of the second guide means 46 make it possible to transmit electromagnetic signals for two orthogonal polarizations and the other two paths make it possible to receive electromagnetic signals for two orthogonal polarizations.

Furthermore, in the connecting point of the second guide means 46 to the radiating source 43, said means comprise an exciter able to reinforce and/or polarize the electromagnetic signals passing through the corresponding transmission paths, using methods known in themselves.

In particular, the exciter makes it possible both to generate the desired polarization for the transmission and to receive the desired polarization in reception. In the case of a plurality of horns, the second guide means 46 comprise as many exciters as horns necessary to perform the mission of the antenna 10.

The rotary joint 23 comprises a stator 51, a rotor 52, a stator cover 53 and a rotor cover 54.

The rotary joint 23 has a ring sector shape with its center positioned on a rotation axis defined by the joint that coincides with the first axis X.

Said sector has a variable opening angle as a function of the position of the rotor 52 with respect to the stator 51 that varies for example between substantially 160° in a minimal opening position and substantially 220° in two maximum opening positions.

Furthermore, said sector defines a plurality of radial directions extending from the ring center toward its periphery and a plurality of circumferential directions extending along concentric circles arranged around the first axis X. Thus, each radial direction and each circumferential direction are located in a plane perpendicular to the first axis X, and in the example embodiment of FIG. 1, perpendicular to the base plane 12.

The rotor 52 and the rotor cover 54 are fastened to the second part 22 of the antenna 10, and in particular to the second rotary support 42. The stator 51 and the stator cover 53 are fastened to the first part 21 of the antenna 10, and in particular to the antenna support 30. Thus, during the rotation of the second part 22 of the antenna 10 with respect to the first part 21, the rotor 52 rotates relative to the first axis X without coming into contact with the stator 51. This rotation then varies the opening angle value of the rotary joint 23.

The rotor 52 and the stator 51 will be explained hereinafter in detail in reference to FIGS. 4 and 5, respectively.

Figure 5:
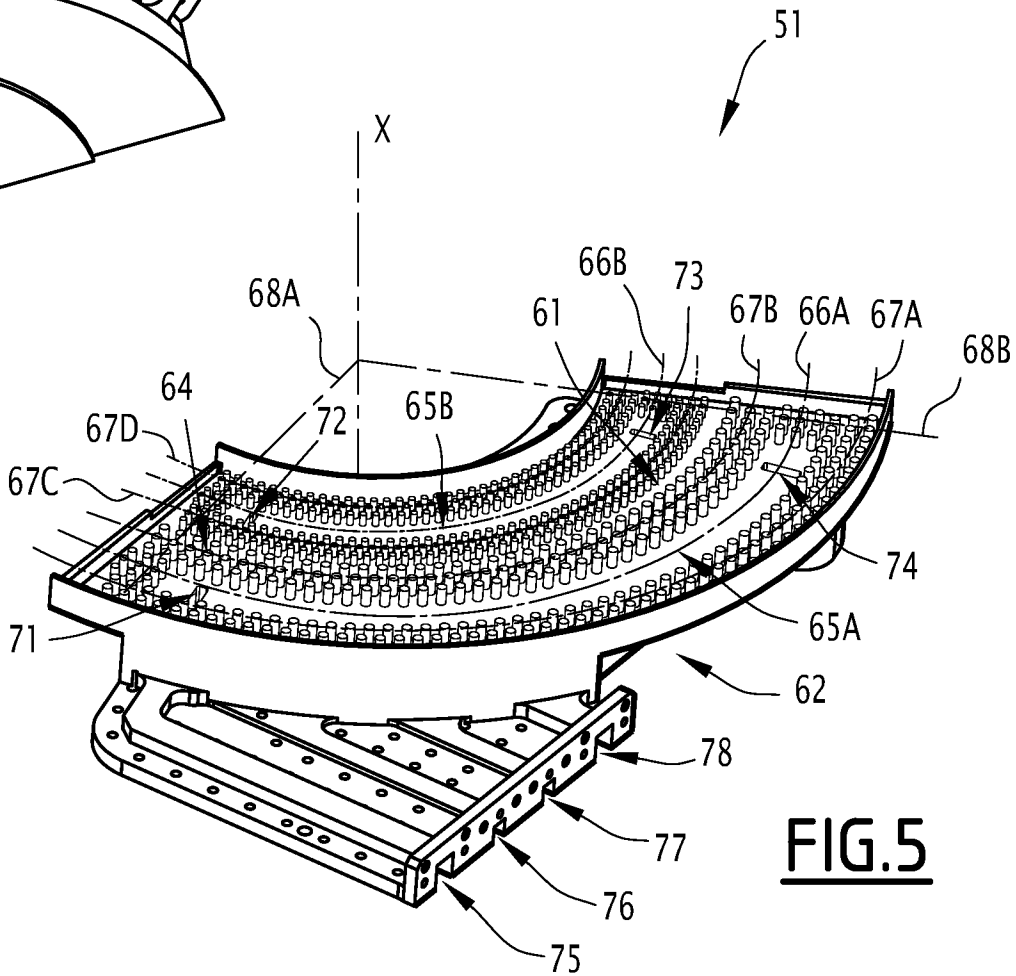
FIG. 5 is a schematic perspective view of the stator of FIG. 2.

Thus, in reference to FIG. 5, the stator 51 has a ring sector shape with a constant opening and with its center positioned on the first axis X. The opening angle of said sector is for example substantially equal to 160°.

The stator 51 is for example made in a single piece from a conductive material.

The stator 51 comprises a transmission surface 61 positioned to face the rotor 52 and a fastening surface 62 covered by the stator cover 53.

The transmission surface 61 comprises primary delimiting means 64 of the electromagnetic signals protruding relative to the transmission surface 61 and forming two transmission channels 65A and 65B for the electromagnetic signals.

Each of said transmission channels 65A, 65B extends along a circumferential direction 66A, 66B and is delimited by the means 64 along each radial and circumferential direction passing through said channel. The width of each of said channels 65A, 65B, i.e., its expanse along each radial direction, is for example substantially equal to 7 mm.

In the example embodiment of FIG. 5, the transmission channel 65A extending along the circumferential direction 66A further from the first axis X than the circumferential direction 66B, is intended to transmit electromagnetic signals to be sent by the antenna 10, i.e., the signals of type Tx.

The transmission channel 65B extending along the circumferential direction 66B closer to the first axis X than the circumferential direction 66A, is intended to transmit electromagnetic signals received by the antenna 10, i.e., the signals of type Rx.

The primary delimiting means 64 assume the form of a plurality of studs spaced apart from one another homogeneously. Said studs for example have a cylindrical shape with a diameter comprised between 1.5 mm and 2.5 mm.

The studs delimiting the same transmission channel 65A, 65B have the same dimensions and are distributed over the transmission surface 61 in several circumferential directions on either side of the corresponding transmission channel and at each end of said channel in several radial directions.

Thus, in the example of FIG. 5, the studs associated with the transmission channel 65A are distributed along three circumferential directions on either side of the channel 65A and along three radial directions at each end of said channel. For simplification reasons, in FIG. 5, only one circumferential direction 67A, 67B on each side of the channel 65A and one radial direction 68A, 68B at each end of said channel, are illustrated.

Similarly, the studs associated with the transmission channel 65B are distributed along three circumferential directions on either side of the channel 65B and along three radial directions at each end of said channel. For simplification reasons, in FIG. 5, only one circumferential direction 67C, 67D on each side of the channel 65B and one radial direction 68C, 68D at each end of said channel, are illustrated.

The spacing pitch of two adjacent studs along the corresponding circumferential or radial direction is for example substantially equal to 3.5 mm.

Furthermore, in this same figure, the height of the studs associated with the transmission channel 65A, i.e., with the channel for the signals of type Tx, is substantially greater than the height of the studs associated with the transmission channel 65B, i.e., with the channel for the signals of type Rx. Thus, the height of the studs associated with the transmission channel 65A is for example substantially equal to 3 mm and the height of the studs associated with the transmission channel 65B is for example substantially equal to 2 mm.

At the end of each transmission channel 65A, 65B, the transmission surface 61 defines an opening 71 to 74 respectively emerging on a waveguide 75 to 78 formed between the fastening surface 62 and the stator cover 53.

Each waveguide 75 to 78 therefore extends in a plane perpendicular to the first axis X and is bent appropriately to connect the corresponding transmission path to the first guide means 36.

Figure 4:
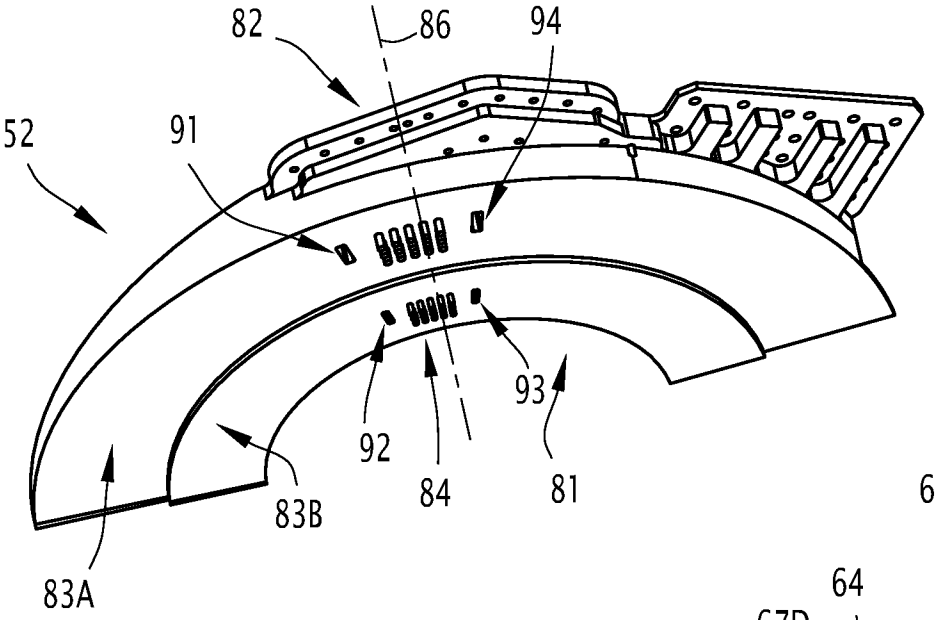
FIG. 4 is a schematic perspective view of the rotor of FIG. 2.

In reference to FIG. 4, the rotor 52 has a ring sector shape with a constant opening substantially similar to that of the stator 51. Like in the previous case, the opening of said sector is for example substantially equal to 160° and the center of said sector is positioned on the first axis X.

Like the stator 51, the rotor 52 is for example made in a single piece from a conductive material and comprises a transmission surface 81 and a fastening surface 82 covered by the rotor cover 54.

In the minimal opening position of the rotary joint 23, the transmission surface 81 of the rotor 52 is positioned substantially entirely to face the transmission surface 61 of the stator 51.

In any other position of the rotary joint 23, a part of the transmission surface 81 of the rotor 52 is positioned to face part of the transmission surface 61 of the stator 51. Furthermore, in each of the maximum opening positions, the surface of the facing parts is minimal.

The first maximum opening position is obtained by rotating the rotor 52 around the first axis X in the counterclockwise direction. The second maximum opening position is obtained by rotating the rotor 52 around the first axis X in the clockwise direction.

In any position of the rotor 52 with respect to the stator 51, the transmission surface 81 of the rotor 52 is moved away from the transmission surface 61 of the stator 51 along the first axis X, by a separation value for example substantially equal to 0.5 mm.

The transmission surfaces 61, 81 form a transmission plane between them for the electromagnetic signals. Said plane is perpendicular to the first axis X and includes, in any position of the rotor 52 relative to the stator 51, four transmission paths for the electromagnetic signals, as will be explained hereinafter.

The transmission surface 81 of the rotor 52 includes two planar surfaces 83A, 83B and complementary delimiting means 84 of the electromagnetic signals.

Each planar surface 83A, 83B is associated with one of the transmission channels 65A, 65B of the stator 51 and is intended to completely cover said channel 65A, 65B with the primary delimiting means 64 associated with said channel 65A, 65B, when the rotary joint 23 is located in the minimal opening position. Thus, each planar surface 83A, 83B has a circumferential shape.

The planar surfaces 83A, 83B are positioned in a stepped manner. Thus, in the example of FIG. 4, the planar surface 83B that is the least far away from the first axis X protrudes relative to the planar surface 83A by a value substantially equal to the difference in the heights of the studs associated with the transmission channel 65A and those associated with the transmission channel 65B.

The complementary delimiting means 84 of the electromagnetic signals are positioned on each of the planar surfaces 83A, 83B and protrude relative to said surface 83A, 83B.

The complementary delimiting means 84 positioned on the planar surface 83A are received in the transmission channel 65A so as to move with the rotation of the rotor 52 such that in any position of the rotor 52 relative to the stator 51, said means split the corresponding transmission channel into two complementary circumferential transmission paths.

Similarly, the complementary delimiting means 84 positioned on the planar surface 83B are received in the transmission channel 65B so as to move with the rotation of the rotor 52 such that in any position of the rotor 52 relative to the stator 51, said means split the corresponding transmission channel into two complementary circumferential transmission paths.

The complementary delimiting means 84 assume the form of a plurality of studs arranged in several radial directions on either side of a central radial direction 86 of the transmission surface 81 and optionally, along said same central radial direction 86.

Central radial direction refers to the radial direction passing through the middle of the sector of the rotor 52, i.e., the radial direction splitting the transmission surface 81 into two substantially equivalent parts.

Thus, in the example embodiment of FIG. 4, the studs are positioned along the central radial direction 86 and along two other radial directions positioned on each side of the central radial direction.

The studs positioned on the planar surface 83A are similar to the studs associated with the transmission channel 65A and the studs positioned on the planar surface 83B are similar to the studs associated with the transmission channel 65B.

Each planar surface 83A, 83B defines two openings 91 to 94 positioned on either side of the central radial direction 86. Each of said openings 91 to 94 is adjacent to the complementary delimiting means 84 such that in any position of the rotor 52 with respect to the stator 51, it emerges on one side on one of the transmission channels 65A, 65B, and on the other side on a waveguide 95 to 98 formed between the fastening surface 82 and the rotor cover 54.

Each waveguide 95 to 98 therefore extends in a plane perpendicular to the first axis X and is bent appropriately to connect the corresponding transmission path to the second guide means 46.

Thus, the cooperation of the rotor 52 with the stator 51 forms, in any position of the rotor 52 with respect to the stator 51, four transmission paths of the electromagnetic signals between the first part 21 of the antenna 10 and the second part 22.

Among these transmission paths, the path formed between the openings 71 and 91 and the path formed between the openings 74 and 94 are intended to transmit the electromechanical signals to be sent via the radiating source 43. The path formed between the openings 72 and 92 and the path formed between the openings 73 and 93 are intended to transmit the electromechanical signals received by the radiating source 43.

The operation of the antenna 10, and in particular its kinetics relative to the axes X and Y, will now be explained in reference to FIG. 6.

Figure 6:
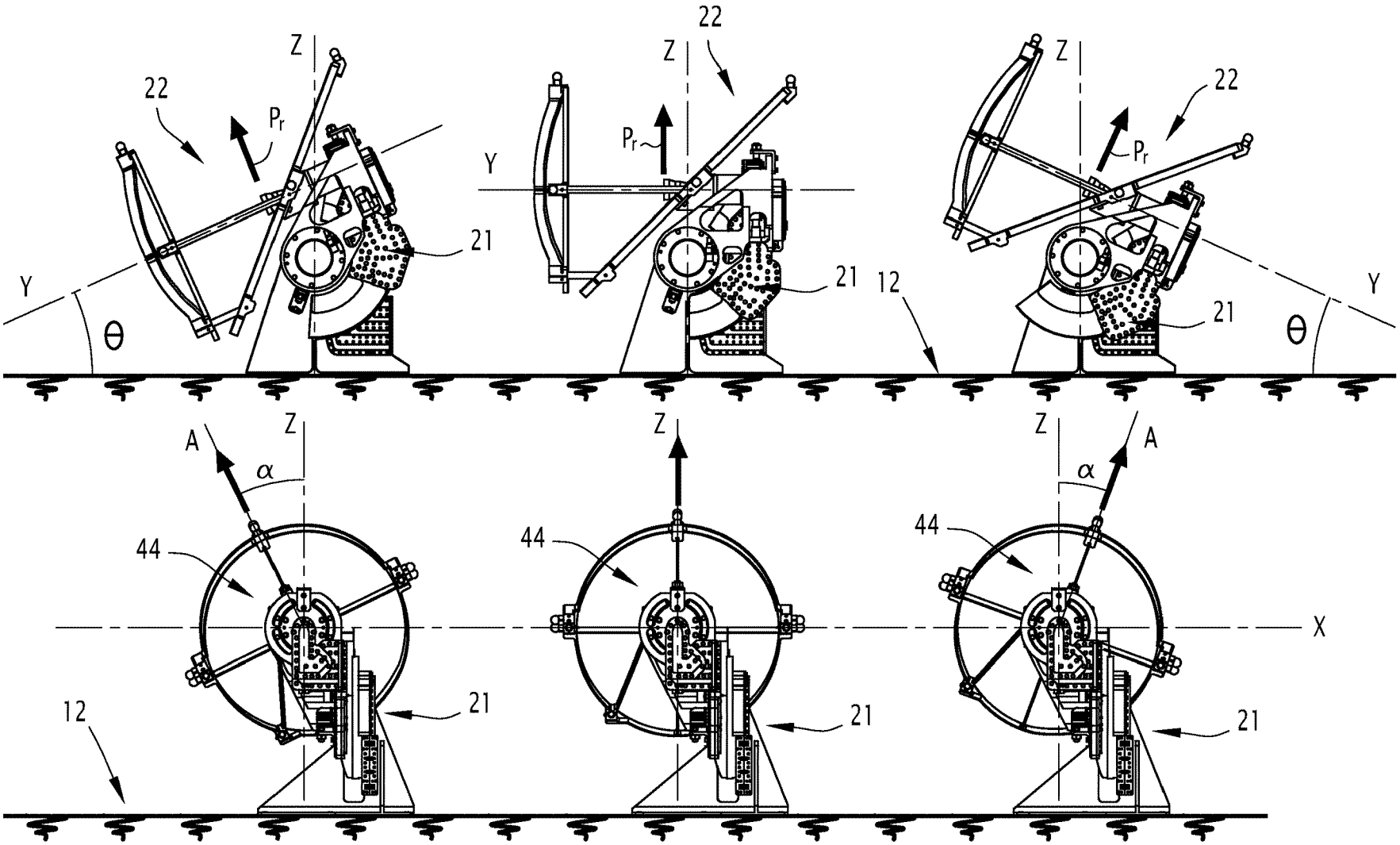
FIG. 6 is a schematic view explaining the kinetics of the antenna of FIG. 1.

Indeed, the top part of FIG. 6 illustrates three different positions of the second part 22 with respect to the first part 21 of the antenna 10 during the rotation of the second part 22 with respect to the first axis, which is then perpendicular to the plane of the top part of FIG. 6.

In the position of the middle, the elevation angle Θ of the antenna 10 formed between the second axis Y and the base plane 12 is equal to 0°. The rotary joint 23 is therefore in its minimal opening position.

When it is necessary to modify this elevation angle Θ, the first actuator is supplied by the satellite to rotate second part 22 of the antenna in the clockwise or counterclockwise direction around the first axis X, based on the sign of the corresponding supply signals.

Thus, in the left position, the second part 22 is rotated around the first axis X in the counterclockwise direction to reach the elevation angle Θ substantially equal to −30°. In this position, the rotary joint 23 is therefore in its first maximum opening position.

In the right position, the second part 22 is rotated around the first axis X in the clockwise direction to reach the elevation angle Θ substantially equal to 30°. In this position, the rotary joint 23 is therefore in its second maximum opening position.

The bottom part of FIG. 6 illustrates three different positions of the reflecting assembly 44 for example with respect to the first part 21 of the antenna 10 during the rotation of the reflecting assembly 44 around the second axis Y, which is then perpendicular to the plane of the bottom part of FIG. 6.

In the position of the middle, the incline angle α formed between the incline axis A and the third axis Z is equal to 0°.

When it is necessary to modify this incline angle α, the second actuator is supplied by the satellite to rotate reflecting assembly 44 of the antenna in the clockwise or counterclockwise direction around the second axis Y, based on the sign of the corresponding supply signals.

Thus, in the left position, the reflecting assembly 44 is rotated around the second axis Y in the counterclockwise direction to reach the incline angle α substantially equal to −30°.

In the right position, the reflecting assembly 44 is rotated around the second axis Y in the clockwise direction to reach the incline angle α substantially equal to 30°.

Thus, by varying the elevation angle Θ and the incline angle α appropriately, it is possible to reach a desired aiming position of the antenna 10 particularly precisely.

One can then see that the present invention has a certain number of advantages.

First of all, by using a rotary joint as previously described, it is possible to receive and send electromagnetic signals with a bandwidth substantially equal to 3 GHz in transmission and 3 GHz in reception and with two orthogonal polarizations in a single-horn configuration, while providing good performance levels of the antenna.

Furthermore, the antenna according to the invention is particularly simple to manufacture and assemble, since the electromagnetic connection between the first and second parts of said antenna is provided by using a very small number of parts. In particular, this connection is provided entirely by the rotary joint, which may be made up solely of a stator and a rotor.

Lastly, such a structure of the rotary joint is not very sensitive to imprecisions in the installation of its various components. Indeed, the arrangement of the rotor slightly separated from the stator is intended to prevent the "escape" of electromagnetic signals circulating in the transmission plane. Thus, this gap may be varied from one antenna to another without significant deterioration of the performance of said antennas. Furthermore, given that said rotary joint has no contact around the transmission paths, it does not limit the lifetime of the antenna.

The invention claimed is:

1. A rotary joint for a rotary antenna comprising a first part and a second part rotating relative to the first part, the rotary joint being intended to connect the first part and the second part of the antenna and to transmit electromagnetic signals between the parts, having a ring sector shape with a variable opening and defining a rotation axis passing through the ring center, a plurality of radial directions extending from the ring center toward its periphery and a plurality of circumferential directions extending along concentric circles arranged around said rotation axis, the rotary joint comprising:

a stator intended to be fastened on the first part of the antenna and defining a surface for transmitting electromagnetic signals, perpendicular to said rotation axis; and a rotor intended to be fastened on the second part of the antenna and defining a surface for transmitting electromagnetic signals, perpendicular to said rotation axis, wherein one of said transmission surfaces includes primary means for delimiting electromagnetic signals and the other includes complementary means for delimiting electromagnetic signals, wherein said rotor is mounted rotating relative to said stator around said rotation axis such that in any position of said rotor, at least a part of said transmission surface of said rotor is positioned to face least a part of said transmission surface of said stator, and wherein in any position of said rotor, the facing parts of said transmission surfaces of said rotor and said stator form at least one transmission path between them for the electromagnetic signals, the transmission path being delimited by said primary and complementary delimiting means and extending in a circumferential direction.

2. The rotary joint according to claim 1, wherein in any position of said rotor, the facing parts of said transmission surfaces of said rotor and said stator form at least two transmission paths between them for the electromagnetic signals, called circumferential paths, the circumferential paths being delimited by said primary and complementary delimiting means and extending in a same circumferential direction.

3. The rotary joint according to claim 1, wherein in any position of said rotor, the facing parts of said transmission surfaces of said rotor and said stator form at least two transmission paths between them for the electromagnetic signals, called radial paths, the radial paths being delimited by said primary and complementary delimiting means and extending in different circumferential directions.

4. The rotary joint according to claim 3, wherein the radial path extending along the circumferential direction closer to said rotation axis than the circumferential direction of the other radial path or each other radial path, is intended to transmit the electromagnetic signals received by the antenna, and wherein the radial path extending along the circumferential direction further from said rotation axis than the circumferential direction of the other radial path or each other radial path, is intended to transmit the electromagnetic signals to be sent by the antenna.

5. The rotary joint according to claim 1, wherein said primary delimiting means protrude relative to the corresponding transmission surface to form at least one transmission channel extending along a circumferential direction and delimited by said delimiting means along each radial and circumferential direction passing through the channel.

6. The rotary joint according to claim 5, wherein said complementary delimiting means protrude relative to the corresponding transmission surface and are received in the or each transmission channel movably in order to delimit the circumferential expanse of the channel as a function of the position of said rotor, the or each transmission path being formed by a portion delimited by said complementary delimiting means of the transmission channel or one of the transmission channels.

7. The rotary joint according to claim 6, wherein in any position of said rotor, the facing parts of said transmission surfaces of said rotor and said stator form at least two transmission paths between them for the electromagnetic signals, called circumferential paths, the circumferential paths being delimited by said primary and complementary delimiting means and extending in a same circumferential direction, and wherein the circumferential paths are formed by adjacent portions of a same transmission channel divided by said complementary delimiting means.

8. The rotary joint according to claim 5, wherein for the or each transmission channel, the transmission surface of said stator defines at least one opening positioned on one of the ends of the channel, and wherein for the or each opening of said transmission surface of said stator, said transmission surface of said rotor defines an opening positioned over the same circumferential direction as the opening of said transmission surface of said stator, the or each transmission path extending between the opening or one of the openings of said transmission surface of said stator and the opening of said transmission surface of said rotor corresponding to it.

9. The rotary joint according to claim 1, wherein said primary and complementary delimiting means assume the form of a plurality of studs spaced apart from one another.

10. The rotary joint according to claim 9, wherein the studs of said primary delimiting means are distributed on the corresponding transmission surface in several circumferential directions and several radial directions.

11. The rotary joint according to claim 1, wherein said transmission surfaces of said rotor and said stator are separated from one another along said rotation axis without forming points of contact.

12. A rotary antenna, comprising:

a first part;

a second part rotating with respect to said first part; and a rotary joint according to claim 1, intended to connect said first and second parts of the antenna and to transmit electromagnetic signals between said parts.

* * * * *